United States Patent [19]

Brunn

[11] Patent Number: 4,521,927

[45] Date of Patent: Jun. 11, 1985

[54] DAVENPORT CONVERTIBLE TO A DOUBLE BED OR A SINGLE BED

[76] Inventor: Oswald Brunn, Bunzlauer Platz 1, 8000 Munich 50, Fed. Rep. of Germany

[21] Appl. No.: 577,247

[22] Filed: Feb. 6, 1984

[51] Int. Cl.[3] ..... A47C 17/32; A47C 17/16

[52] U.S. Cl. ..... 5/37 R; 5/43; 5/47; 5/68; 297/342

[58] Field of Search ..... 5/37 R, 37 B, 37 C, 5/39, 41, 43, 46 R, 46 B, 47, 16, 20, 21, 23, 25, 68; 297/342, 364

[56] References Cited

U.S. PATENT DOCUMENTS

| | | | |
|---|---|---|---|
| 2,769,987 | 11/1956 | Thal | 5/37 R |
| 4,099,768 | 7/1978 | Amos | 5/37 R |
| 4,321,717 | 3/1982 | Serra | 5/43 |

FOREIGN PATENT DOCUMENTS

| | | | |
|---|---|---|---|
| 509133 | 2/1952 | Belgium | 5/47 |
| 1181876 | 11/1964 | Fed. Rep. of Germany . | |
| 1779031 | 8/1971 | Fed. Rep. of Germany . | |
| 34141 | 12/1964 | German Democratic Rep. . | |
| 196318 | 6/1938 | Switzerland | 5/47 |

*Primary Examiner*—Alexander Grosz

[57] ABSTRACT

The invention relates to a davenport having two beds 1 and 2, which are disposed side by side on a supporting frame 3, the one bed being raisable to serve as the back of a sofa, while the other bed is superimposed evenly on the supporting frame 3. Furthermore, the bed forming the back rest can be placed over the seat bed 1 face-up and congruently therewith, and congruently with the frame 3. The beds are joined together at their end frame members 9 and 10 by means of coupling bars 11 and 12. Each coupling bar is mounted on the seat bed 1 by means of a pin 13 at a distance a from the rear edge of the seat bed 1, and by means of two pins 15 and 16, and 17 and 18, to the back bed 2. The bottom pin 15 and 17 of the back bed is extractable.

13 Claims, 8 Drawing Figures

DAVENPORT CONVERTIBLE TO A DOUBLE BED OR A SINGLE BED

BACKGROUND OF THE INVENTION

The invention relates to a davenport having two beds disposed side by side on a supporting frame, the one bed (back bed) being able to be tilted upward with respect to the other bed (seat bed) so as to serve as the back of a sofa such that the front/bottom edge of the back comes above the rear area of the seat.

Such a davenport is already known from German Pat. No. 1,181,876, although it is designed primarily as a sofa, i.e., for seating. To swing to the horizontal position, the end frame members of the back bed are elongated downwardly and articulated at their bottom ends to the seat frame. In the normal position, i.e., when serving as a sofa back, the back bed is supported at the rear by a supporting anchor, which is articulated on the one hand to the bottom portion of the end frame member and on the other hand to the rear end of the supporting frame. When the back is folded downwardly, the supporting links thus simultaneously swing about their bottom horizontal axis and push the back bed—and the seat bed also—forwardly with respect to the supporting frame, so that therefore the seat bed and the back bed will each come to rest partially on and partially cantilevered over either side of the supporting frame.

Aside from the fact that the back bed is relatively narrow, corresponding to the height of a sofa back, it would be very desirable for the davenport to be usable also as a single bed of normal width. Of course, one can sleep on a sofa, such as the one described in German Pat. No. 1,181,876, namely on the seat part, but the complaint can be made that the seat part is too narrow to serve as a bed. Even though the seat part extends further back under the back part, all that is available to lie on is the width from the front edge to the back rest, but this width is determined by the conventional "seat depth", i.e., the anatomical measure from the sitter's calves to the sitter's back.

It is the object of the invention to design a davenport of the kind described above, which will be convertible not only from a sofa (with normal seat depth) to a double bed and vice versa, but also to a single bed of conventional width, combining simplicity of operation with simplicity of design.

BRIEF DESCRIPTION OF THE INVENTION

This object is achieved in accordance with the invention by joining the two beds together at their two end frame members by means of coupling bars which are attached by means of pivot pins, at a distance from the rear edge of the seat bed, to the end frame member of the seat bed and by means of two pairs of pins to the end frame members of the back bed, and that one pair of pins of the back bed can be released from their engagement with the coupling bars.

In accordance with the invention, therefore, two additional coupling bars are provided for the articulation between the seat bed and the back bed, and these coupling bars are mounted by means of two pins on the end frame members of the sofa back (back bed), and their projecting bottom ends are attached to the end frame members of the seat bed. The back bed, or sofa back, can be pivoted about the last-mentioned pins from the position in which it serves as a sofa back (in which position it is held or supported by conventional means), to the horizontal position in which it can be used as a bed, and vice versa. If only one bed is needed, in which case the raised sofa back would be undesirable since it occupies part of the width of the seat bed, and in any case sticks up uselessly and unattractively into the air, the user need only release the lower pins of the back bed from the coupling bars; the user can then fold the back bed about the upper pins and at the same time swing the coupling bars about their bottom pivot axes forwardly with respect to the seat bed, so that the back bed will coincide with the seat bed, and the back bed can then serve as a normal bed. It is also a great advantage that the back bed comes to rest on the seat bed with its service side up, so that one can lie on the "good side," that is, the padded side of the sofa back. It is also advantageous that, when the davenport is in the single-bed position, the seat bed is sheltered by the back bed, i.e., it is protected against environmental influences such as sun and rain when used as outdoor furniture.

Additional special features are set forth in the subordinate claims.

When the back bed is folded, it is best to shift the seat bed and back bed with respect to the supporting frame. According to German Pat. No. 1,181,876, a guiding means is provided for this purpose on the supporting frame, and in it a slide block or roller attached to the seat is guided.

In further development of the invention, provision is made in this regard such that the articulation pins corresponding to the seat bed are guided by each of their projecting ends in a groove provided in each cross member of the supporting frame. These articulation pins thus serve simultaneously as guiding means.

Preferably the groove is slightly angled downwardly and forwardly in order to facilitate shifting to the double-bed position and holding in that position. At the rear end of the groove a notch is provided into which the articulation pin snaps when the back bed is shifted up to the sofa position. The rear edge of the seat bed is best supported against the supporting frame in that case. For if the seat bed is raised up at its front edge, the pins are lifted out of the notches in the two grooves, and then, by a slight forward pull, the seat bed plus the back bed are pulled forward with respect to the supporting frame (to the symmetrical horizontal bed position); this operation is facilitated by the weight of the sofa back, which thus simultaneously comes into the horizontal position.

In the reverse change-over from the double-bed position to the sofa position, it is necessary to act against the force of gravity. To make this easier, a spring mechanism can be provided, which is tensioned by the shift from the sofa position to the double bed position; the spring energy thus stored up then facilitates the return from the double-bed position to the sofa position. This purpose can be served, for example, by two tension coil springs attached laterally between a rear portion of the supporting frame and a front part of the seat bed (or, vice versa, compression springs).

It could be considered to be too complicated if the user first had to take the trouble to release both of the lower pins of the back bed; a mechanism can therefore be provided whereby these two pins can be released simultaneously from their engagement with the coupling bar by a single manipulation with the hand. Such a mechanism will be explained in detail in the description given of the drawings.

As a further development, both beds are designed as so-called "health beds," i.e., consisting each of a frame on which or in which a lath grid is provided, while a middle portion, the seat part, of the lath grid is fixedly mounted on the frame, while a foot part and a back rest can be folded to the desired angle.

BRIEF DESCRIPTION OF THE DRAWING

To further explain the invention, a description will now be given of one of its embodiments, in conjunction with the drawing, wherein.

DETAILED DESCRIPTION OF THE DRAWING

Figure 1:
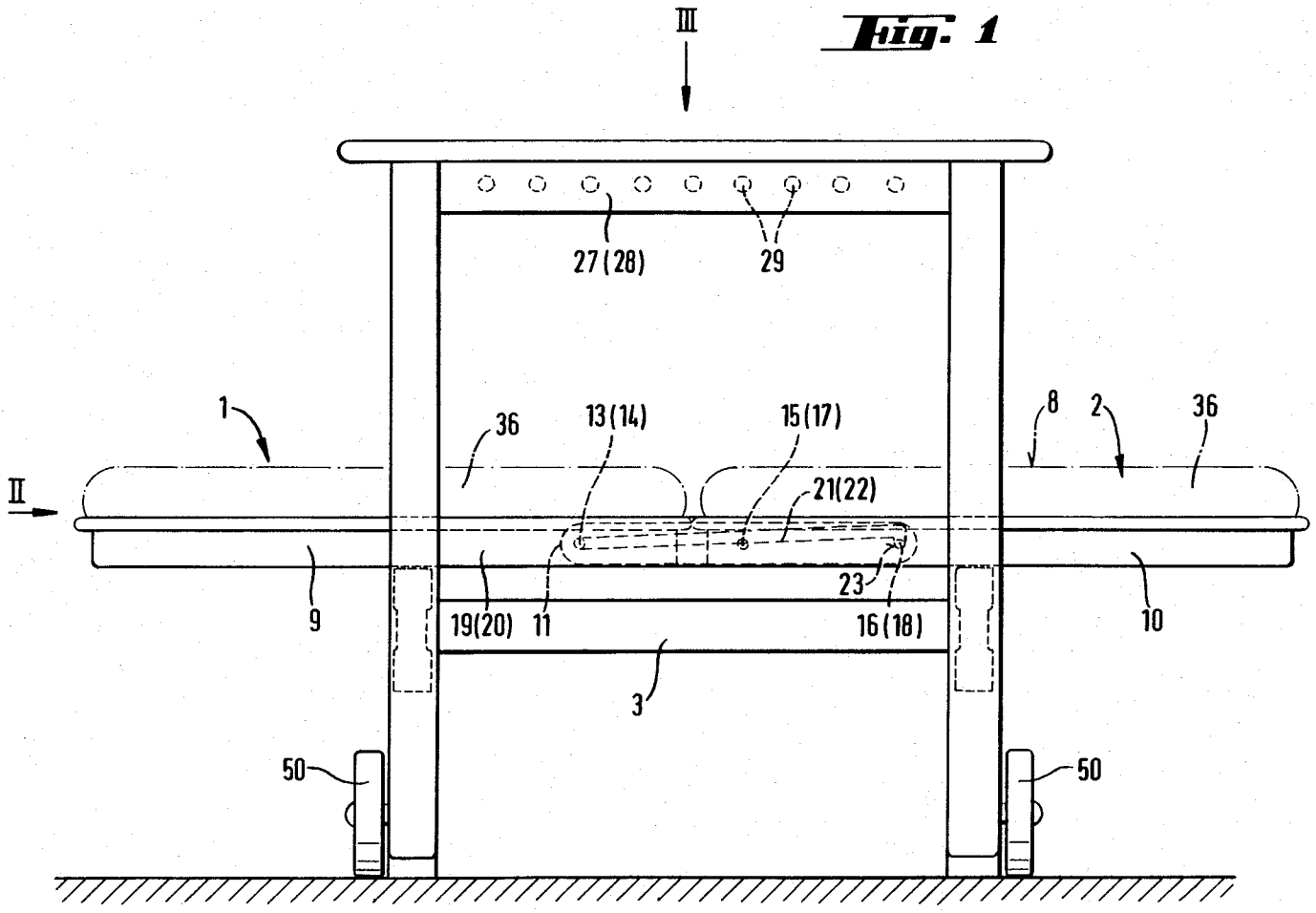
FIG. 1 is a front view of a davenport of the invention, in position for use as a double bed.

On a supporting frame 3 which can be moved about on wheels 50, two basically equal beds 1 and 2 are disposed lengthwise, i.e., in the direction of travel, one of them designated as the seat bed 1 and the other as the back bed 2. In FIG. 1, the seat bed 1 and back bed 2 are disposed horizontally side by side, in symmetry with the supporting frame 3. The beds 1 and 2 have approximately the same width as the supporting frame 3, that is, in the double-bed position represented in FIG. 1, they extend beyond the supporting frame by just about half their width. At their two end frame members 9 and 10, the two beds 1 and 2 are joined together each by one coupling bar, for a total of two coupling bars 11 and 12.

Figure 4:
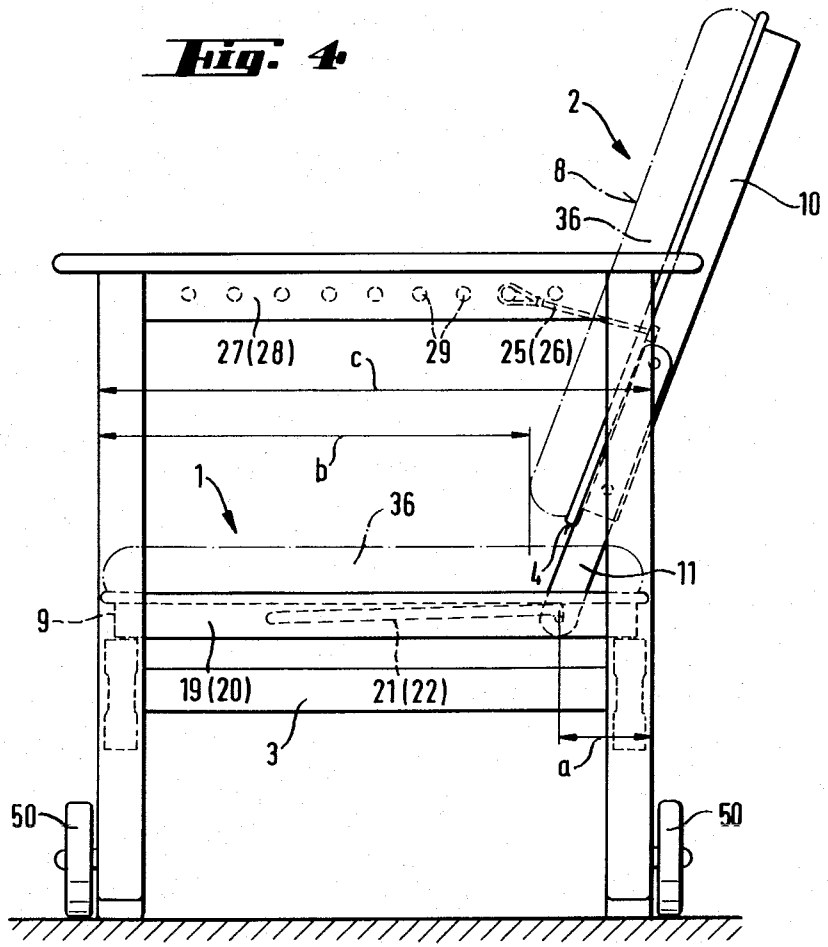
FIG. 4 shows the davenport in position for use as a sofa, i.e., with the "back rest" raised, as seen in the same direction as in FIG. 1.

By virtue of this coupling, the two beds are displaceable with respect to the supporting frame, and the back bed 2 can be tilted up or down in a special manner with respect to the seat bed 1 to a sofa position shown in FIG. 4; also, the back bed is also tiltable such that, for use as a single bed, its upper or top side can be raised upward so as to be placed on and coincide with the seat bed and supporting frame. That is to say, each coupling bar 11 and 12 is articulated at its one end to an articulation pin 13 and 14 on the end frame member 9 of the seat bed 1 and is fastened by two pins 15–16 and 17–18, respectively, to the end frame member 10 of the back bed 2. The back bed 2, therefore, can be swung upward to serve as a sofa back (FIG. 4). The articulation bore on the seat bed 1 is in this case set forward by a distance a such that precisely the anatomically correct seat depth b results, even though the seat bed has, like the back bed, a greater width c, identical for each, as is necessary for comfortable sleeping. In the sofa position, the bottom edge 4 of the back bed 2 comes into position over the cushion 36 of the seat bed 1, while the entire width of the back bed 2 is available as a high, comfortable back rest.

Figure 5:
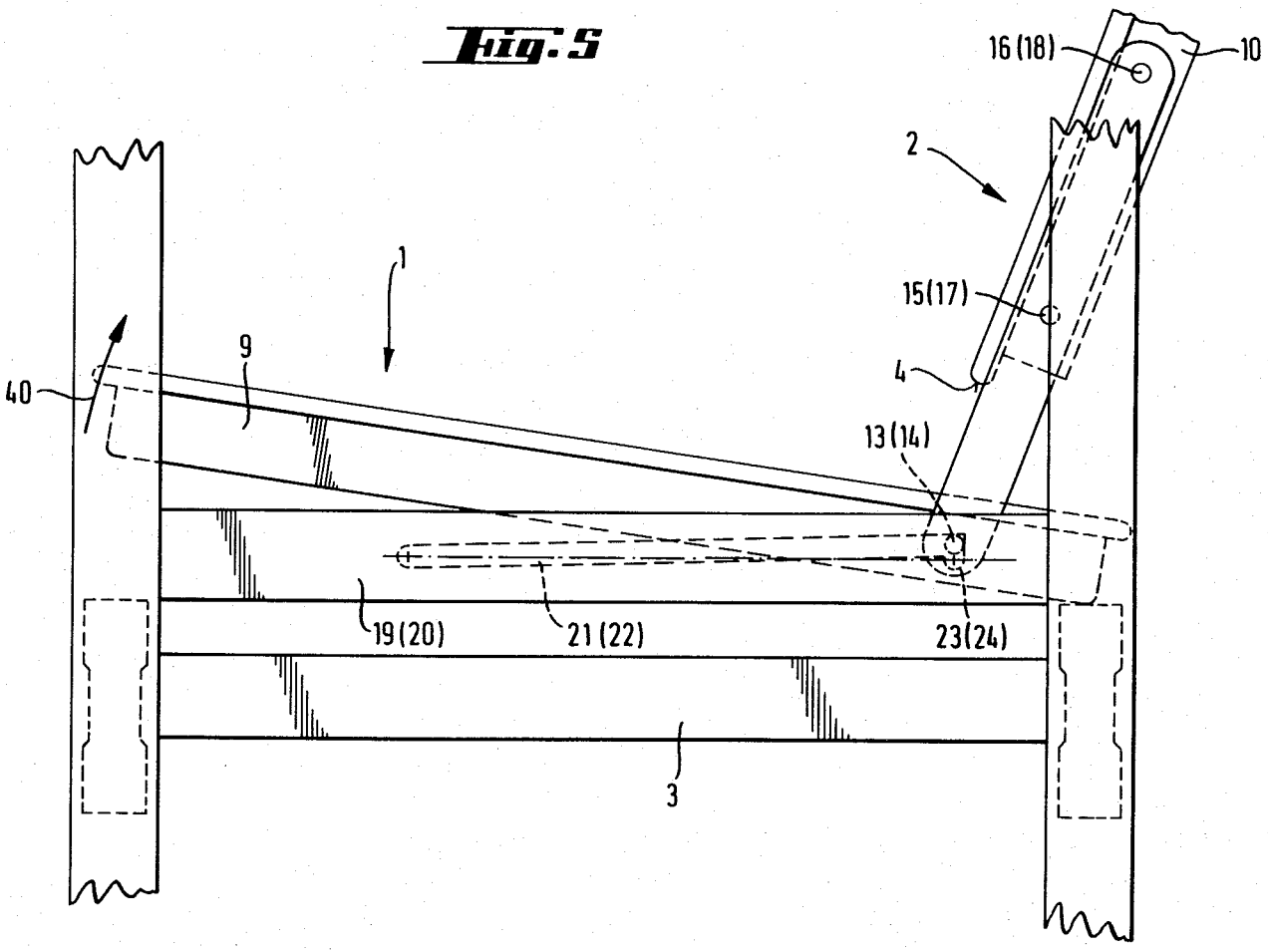
FIG. 5 is an enlarged, fragmentary view, of an intermediate position during the return of the davenport from the sofa position shown in FIG. 1 to the bed position shown in FIG. 4, showing more clearly how the two beds are joined to one another and to the supporting frame.

In fact, the back bed 2 must not only be swung upwardly, but at the same time the seat bed 1 and back bed 2 must be shifted rearwardly with respect to the supporting frame 3 (from FIG. 1 to FIG. 4). For this purpose the pins 13 and 14 project beyond the coupling rods 11 and 12, and these projecting ends **13*a* and 14*a* are guided each in a groove 21 and 22 on a horizontal rail 19 and 20 of the supporting frame. (See especially FIGS. 4 and 5.) The groove 21–22 slopes slightly toward the front. The front end of the groove 21–22 limits the forward movement at the double bed position. At the rear end of the groove there is a notch 23–24 into which the pin ends 13*a*–14*a* catch in the sofa position (FIG. 4), and this positions the beds (now the seat and back rest of the sofa) correctly with respect to the supporting frame 3**.

To the back bed 2 there is attached at each end a cable 25–26 with an end loop; the end loop can be hung on any one of a series of pins 29 provided on an upper rail 27–28 of the supporting frame 3, so that the inclination of the back bed (or sofa back) is adjustable. If it is desired to shift the sofa bed back from the sofa position (FIG. 4) to the double bed position (FIG. 1), one need only swing up the seat bed by its front rail (arrow 40 in FIG. 5) until the pins 13–14 are raised up out of the notch 23–24. Upon a gentle pull forward, the seat bed and back bed 2 slide to the position represented in FIG. 1, the pins being guided in the inclined groove 21–22; the back bed simultaneously swings to the horizontal position. Provision is made for the seat bed to rest with its bottom rear edge on the supporting frame, thus providing the necessary pivot point. The weight of the back bed assists this movement. When a certain, preferred sofa-back angle is reached, the distance to the point of suspension is equal, so that the cables 25–26 do not have to be released.

When shifting the back bed back from the double-bed position (FIG. 1) to the sofa position (FIG. 4), it is necessary to act against the force of gravity. To facilitate this operation, a spring mechanism can be provided, which can be constructed in various ways and therefore has been omitted from the drawing to avoid complicating it.

Figure 6:
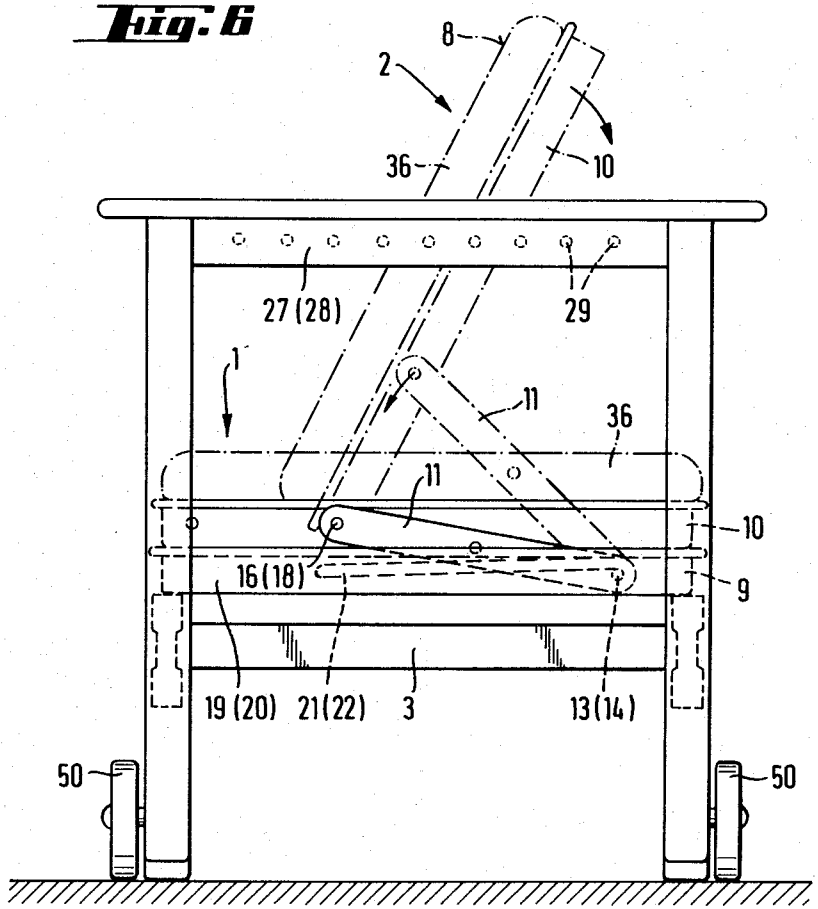
FIG. 6 is an elevational view in the lengthwise direction in the position for use as a bed for one person (an intermediate position is shown in broken lines)

The davenport can also be used especially as a single bed as shown in FIG. 6. In this case the back bed lies with its cushion side 8 up.

For this purpose, the bottom bolt 15, 17, of the back bed 2 can be withdrawn from engagement with the coupling bar 11, 12, so that the back bed 2 can pivot about the upper bolt 16, 18, while at the same time the coupling bar 11–12 (and with it the back bed 2) can be swung about the pin 13–14 with respect to the seat bed 1.

Figure 7:
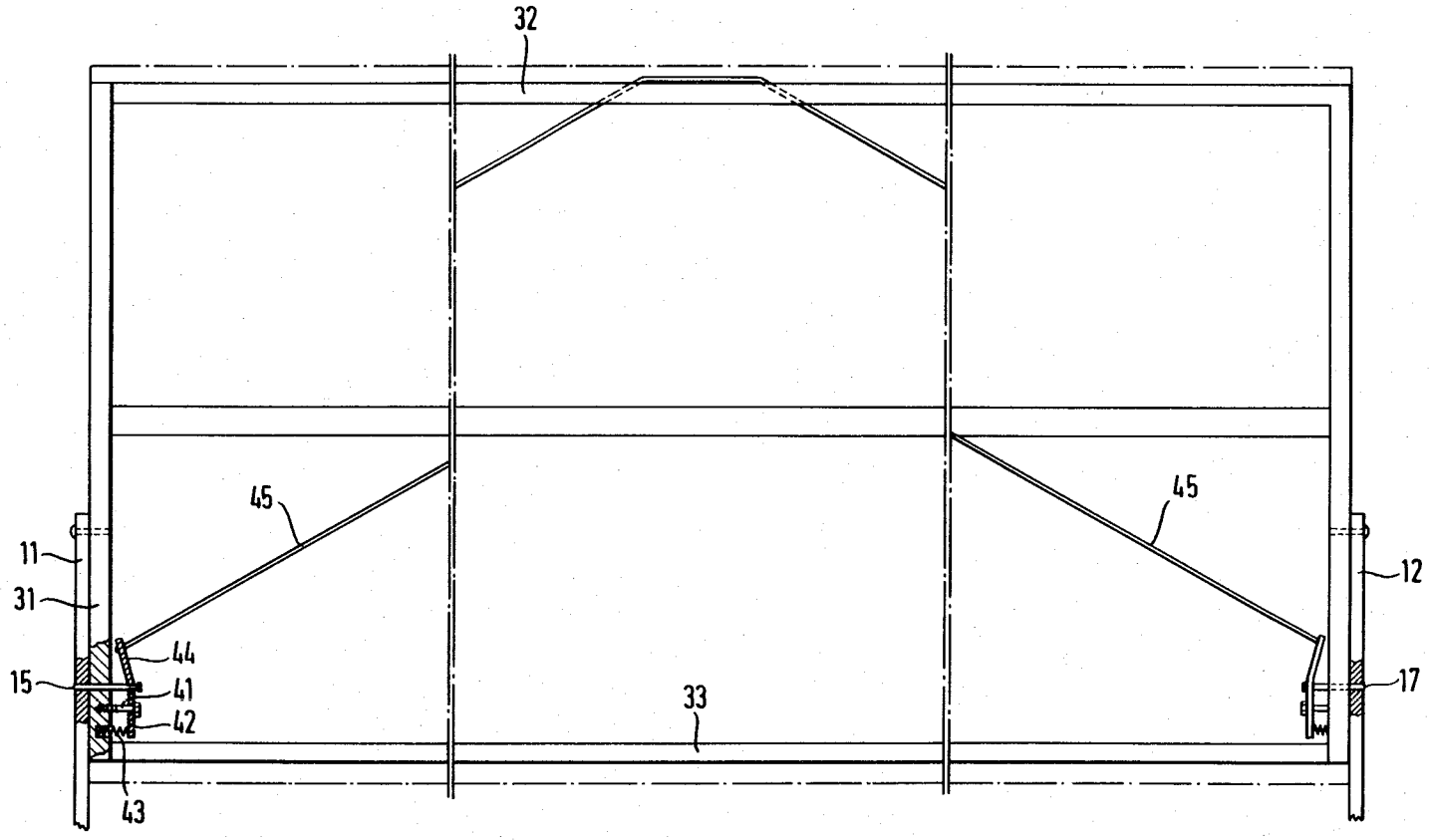
FIG. 7 shows an unlocking mechanism.
Figure 8:
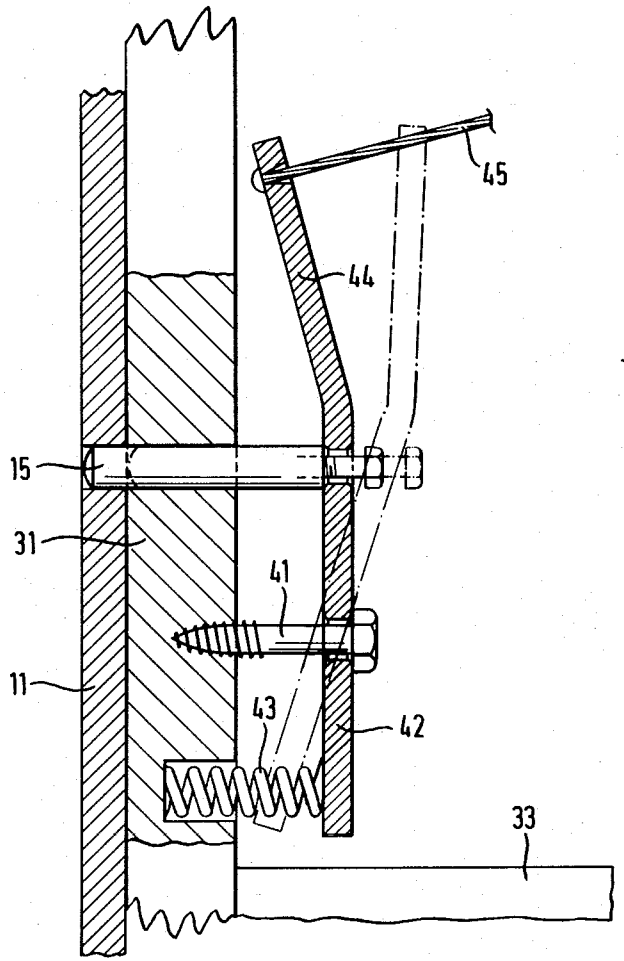
FIG. 8 shows a detail of FIG. 7, enlarged.

By means of the mechanism shown in FIGS. 7 and 8, the two bottom pins can be released simultaneously by pulling at a single point. For this purpose, a two-arm lever 42 is mounted by means of a screw 41 to the end frame member 31 of the bed. A spring 43 acts against the one lever arm 42, and a pull cable is attached to the other lever arm 44, and the pins 15 and 17 are attached in an appropriately movable manner between the pull cable 45 and the screw. The compression spring 43 therefore holds the pin in engagement with the coupling bar 11, 12, and by means of the pull cable 45 both of the pins 15 and 17 can be released against the force of the spring. In FIG. 7, the pull cable 45, which is common to both pins, runs up to and through the upper cross member 32 of the back bed 2, so that it can be grasped at the top. The user, therefore, does not have to stoop to operate it. The cable routing is simpler, however, if the pull cable is run to the lower cross member 33.

Figure 2:
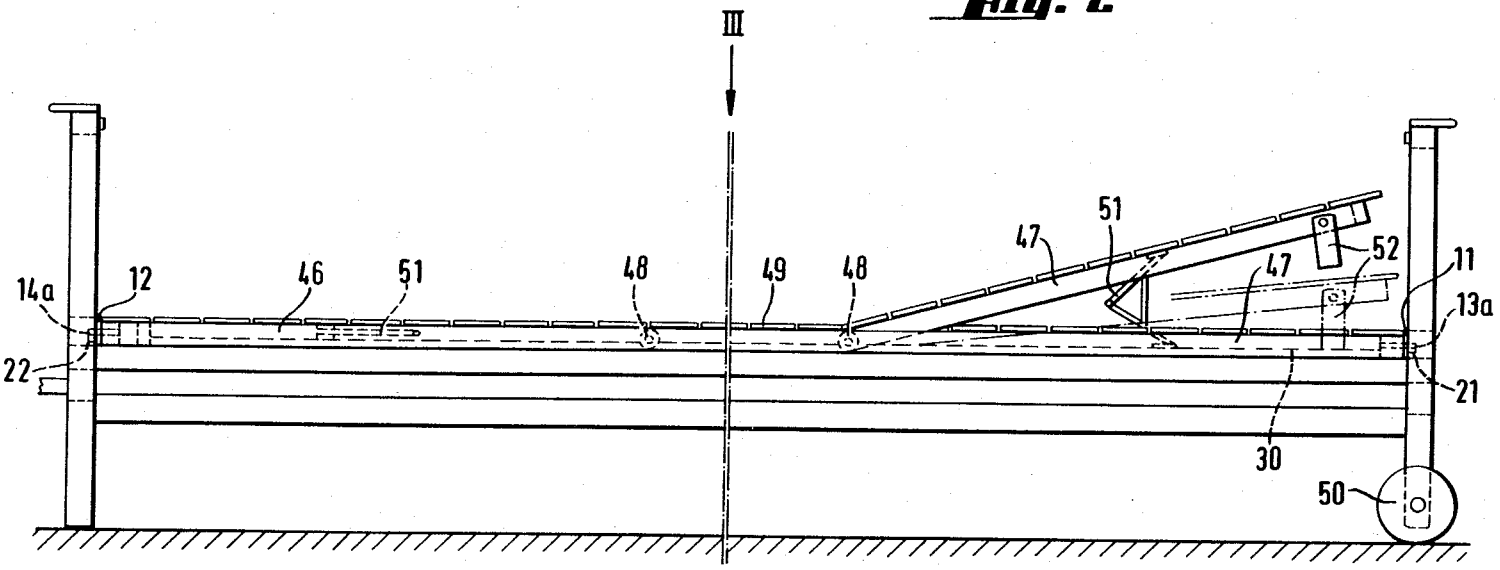
FIG. 2 is a side view of the davenport as seen in the direction of the arrow II in FIGS. 1 and 3.
Figure 3:
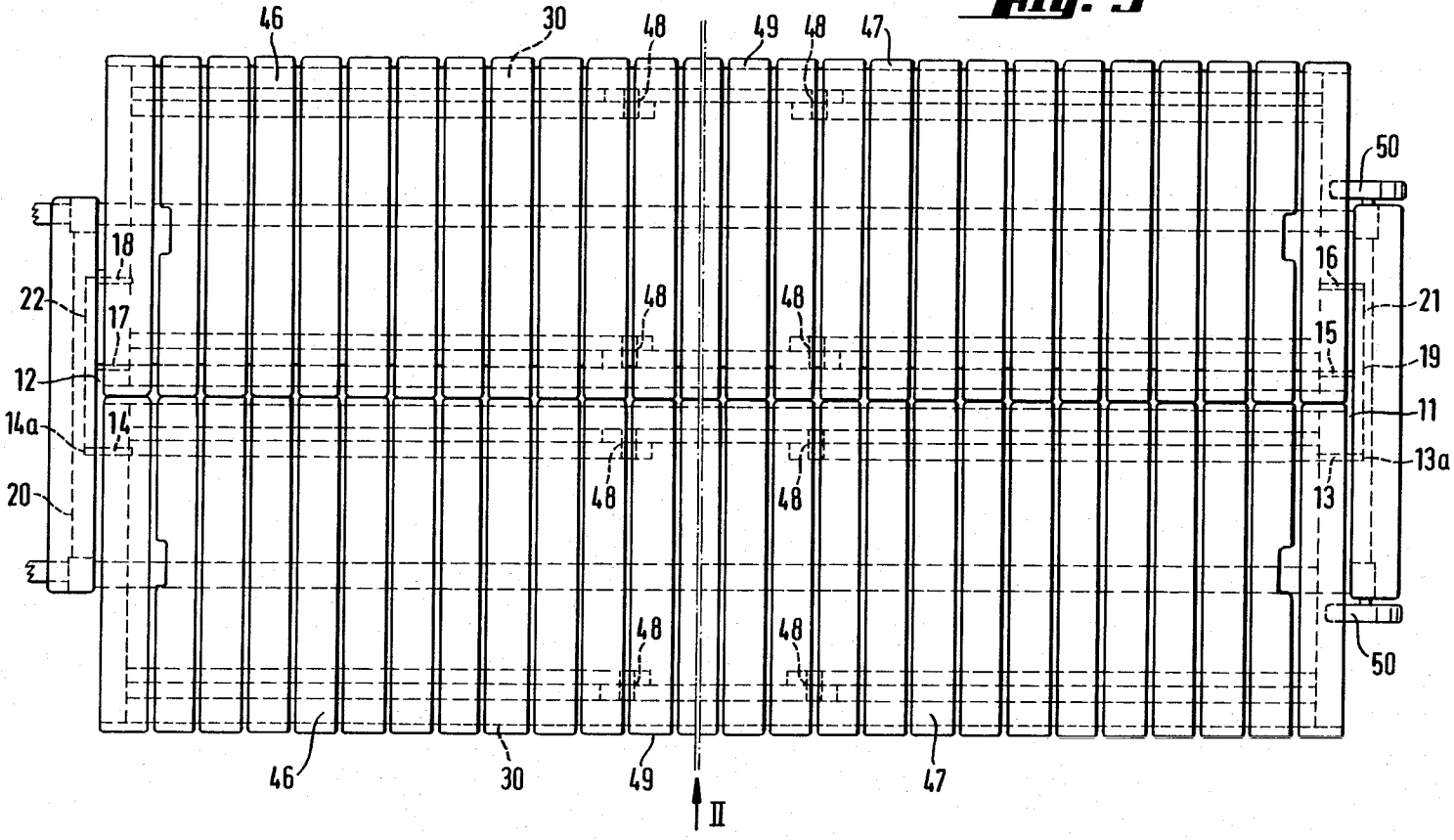
FIG. 3 is a top view (arrow III in FIGS. 1 and 2)

As it can be seen from FIGS. 2 and 3, the two beds with the raisable foot 46 and raisable back rest 47 are in the form of so-called "health beds." For this purpose, each bed has a rectangular frame 30 to whose middle portion a seat part 49 is fixedly attached. The foot part 46 is articulated to the one end of the seat part 49, and the back part 47 to the other end thereof (joints 48). The angle of inclination is adjustable by means of an adjustable support 51.

Heretofore the danger has existed of pinching one's fingers if one attempted to adjust the back rest 47 while seated on the middle part, seat 49. This danger is eliminated by providing two support legs 52 on either side of the upper end, such that they depend freely and come to rest on the frame 30 of the bed when the back is at a very low angle. This minimum angle is nevertheless great enough to provide some room between the back and the frame for the fingers of a hand inserted underneath the back rest 47, so that they cannot be pinched. The foot part 46 is constructed the same as the back rest 47. Between the two beds a gap can be provided (by making the beds slightly narrower), so that one can reach between them to change the position of the back rest.

I claim:

1. A davenport comprising: two beds disposed on a supporting frame having a front edge, each bed having a front edge, a rear edge, and two opposite end frame members, one bed being foldable upwardly with respect to the other bed to form a sofa back such that the front edge of the sofa back is located above the rear edge of the other bed, one bed being adapted to be placed over the other bed face up and congruently therewith, two coupling bars joining the respective end frame members of said beds, two pivot pins arranged at a certain distance from the rear edge of said other bed and pivotally connecting the respective coupling bar to the respective end frame member of said other bed, and two pairs of pins for connecting the respective coupling bar to the respective end frame member of the one bed, one pair of said pairs of pins being releasable from engagement with the coupling bars.

2. A davenport according to claim 1, wherein the pivot pins have ends projecting beyond the coupling bar, said ends being respectively displaceable in grooves provided in a cross member of the supporting frame.

3. A davenport according to claim 2, wherein each groove is inclined slightly downwardly toward the front edge of the supporting frame, and each groove has a notch at its end opposite said front edge to catch the respective pivot pin in the upwardly folded position of the one bed.

4. A davenport according to claim 2, wherein said rear edge of said other bed comes to rest on the supporting frame in the upwardly folded position of the one bed.

5. A davenport according to claim 1, comprising pulling means connected to the end frame members of the one bed and adapted to be fastened adjustably to an upper cross member of the supporting frame.

6. A davenport according to claim 1 or 2, comprising a mechanism for the simultaneous withdrawal of said one pair of pins.

7. A davenport according to claim 6, wherein said withdrawal mechanism comprises a lever on each end frame member of the one bed, a compression spring thrusting against one arm of said lever, a pull cable engaging the other arm of said lever, the pins of said one pair of pins being respectively fastened to the lever between the pull cable and the fulcrum of the lever.

8. A davenport according to claim 1, wherein each bed comprises a rectangular frame and a support disposed thereon.

9. A davenport according to claim 8, wherein said support comprises a middle part fixedly disposed on the frame, and two parts raisable with respect to said middle part to a desired slope, namely a back part and a foot part.

10. A davenport according to claim 9, wherein the back part and the foot part are identical.

11. A davenport according to any one of claims 8 to 10, wherein said support is a lath grid.

12. A davenport according to any one of claims 8 to 10, comprising at least one safety support on the free end of the back part and foot part which project downwardly during raising of the respective part.

13. A davenport according to claim 12, wherein each safety support is formed by a supporting leg which is pivoted at one end about a horizontal axis.

* * * * *